United States Patent [19]

Yoshida et al.

[11] Patent Number: 5,018,556

[45] Date of Patent: May 28, 1991

[54] DOBBY LOOM WITH A MAGNETICALLY OPERATED HOOK SELECTOR

[75] Inventors: Kaichiro Yoshida; Hiroshi Takada, both of Kyoto; Toshio Nakajima, Ohsaka, all of Japan

[73] Assignee: Murata Kikai Kabushiki Kaisha, Kyoto, Japan

[21] Appl. No.: 328,497

[22] Filed: Mar. 24, 1989

[30] Foreign Application Priority Data

| | | | |
|---|---|---|---|
| Apr. 1, 1988 | [JP] | Japan | 63-78152 |
| May 13, 1988 | [JP] | Japan | 63-116741 |
| May 16, 1988 | [JP] | Japan | 63-118735 |

[51] Int. Cl.[5] ..... D03C 1/00

[52] U.S. Cl. ..... 139/68; 139/455

[58] Field of Search ..... 139/455, 65, 66 R, 67, 139/68, 71, 72; 66/220, 219, 232

[56] References Cited

U.S. PATENT DOCUMENTS

| | | | |
|---|---|---|---|
| 3,861,173 | 1/1975 | Kinkelin | 66/220 |
| 4,100,768 | 7/1978 | Kamikura et al. | 66/232 |
| 4,442,869 | 4/1984 | Speich et al. | 139/71 |
| 4,527,597 | 7/1985 | Yoshida et al. | 139/68 |
| 4,702,286 | 10/1987 | Palau et al. | 139/65 |
| 4,715,198 | 12/1987 | Ploppa et al. | 66/219 X |

*Primary Examiner*—Andrew M. Falik

*Attorney, Agent, or Firm*—Spensley Horn Jubas & Lubitz

[57] ABSTRACT

A dobby loom provided with up-and-down movement instruction apparatus which is controlled to two positions, operation and non-operation positions, by programmed magnetically-driven apparatus and wherein the instruction apparatus decides up-and-down movements of a held frame according to the two operation and non-operation positions. The magnetically-driven apparatus includes a magnet core and a movable lever, movable to a first position to select one of the operation and nonoperation positions and to a second position to select the other of the operation and nonoperation positions. The movement of the movable lever is controlled by magnetic force selectably provided between the magnetic core and the movable lever. A plate of non-magnetic material is interposed between the magnet core and the movable lever.

8 Claims, 10 Drawing Sheets

DOBBY LOOM WITH A MAGNETICALLY OPERATED HOOK SELECTOR

FIELD OF THE INVENTION

The present invention relates to a dobby loom, and more particularly, to a dobby loom in which up-and-down control of a held frame is carried out electrically without relying upon a peg card.

RELATED ART STATEMENT

In a loom having a held frame, the case where the held frame is moved up and down by a negative dobby loom will be described with reference to FIG. 17.

In FIG. 17, reference numeral 1 designates a frame of a loom; 2, a held frame; and 3, a dobby loom. First, the held frame 2 is suspended movably up and down by connecting rods 4 and 4 on opposite ends thereof. Although not shown, the held frame 2 is always held at a position shown by means of a spring. On the other hand, a wire 5 is connected to the held frame 2 and connected to the dobby loom 3 through a guide roller 6 so that when the wire 5 is withdrawn as indicated at 7 by the dobby loom 3, the held frame 2 is moved downward against the force of the spring.

A plurality of held frames 2 are provided in a direction of paper, and warps are threaded through the held frames 2. The held frames 2 are suitably alternately moved up and down and a weft is threaded through an opening for the warp formed therebetween to perform weaving.

The dobby loom 3 for withdrawing the wire 5 will be described with reference to FIG. 16.

First, an end 5*a* of the wire 5 is connected into the body 10 of the dobby loom, and a rotatable jack lever 11 for withdrawing the wire 5 is provided rotatably about a fixed shaft 12.

A V-shaped lever 14 is connected to the jack lever 11 through a lever ratio adjusting arm 13, the lever 14 being provided rotatably about a fixed shaft 15.

A balk plate 18 having movable hooks 17*a* and 17*b* on both ends is connected to the V-shaped lever 14.

On the other hand, a reciprocating lever 21 which engages a cam shaft 19*a* of a cam 19 and reciprocates in a direction as indicated at arrow 20 by rotation of the cam 19 is provided, and a driving lever 23 is connected to the end of the reciprocating lever by means of a pin 22. Although not shown, the driving lever 23 is secured to the body 10 of the dobby loom so that the former may be rotated at the same position as that of the pin 16 of the substantially V-shaped lever 14, and pressing elements 23*a* and 23*b* on the both ends thereof are provided so as to come into contact with the back surfaces on the side opposite the movable hooks 17*a* and 17*b* of the balk plate 18.

In the body 10 of the dobby loom, holding hooks 25*a* and 25*b* having movable hooks 24*a* and 24*b* in engagement with the movable hooks 17*a* and 17*b* of the balk plate 18 are provided rotatably about fixed shafts 26*a* and 26*b*, respectively.

The holding hooks 25*a* and 25*b* are urged by springs 27*a* and 27*b*, respectively, so that contactors 28*a* and 28*b* are always in contact with a card drum 29 later described.

A number of cards 30 are mounted on the peripheral surface of the card drum 29, and a peg 31 for moving upward the held frame 2 which has been explained in connection with FIG. 17 is mounted on the card 30 according to the pattern.

This will be further described. When the peg 31 is present in a position corresponding to the contactors 28*a* and 28*b* of the holding hooks 25*a* and 25*b*, the hook portions 24*a* and 24*b* of the holding hooks 25*a* and 25*b* engage the movable hooks 17*a* and 17*b* of the balk plate 18. In the illustration, the hook portion 24*a* of the upper holding hook 25*a* engages the movable hook 17*a* of the balk plate 18 by contact of the peg 31 with the contactor 28*a*, and the hook portion 24*b* of the lower holding hook 25*b* is not in engagement with the movable hook 17*b* of the balk plate 18 since the peg 31 is not mounted at the position of the contactor 27*b*.

When in that state, the reciprocating lever 21 is reciprocated in a direction as indicated at arrow 20 in the figure by means of the cam 19, the driving lever 23 is rotated. At that time, when the driving lever 23 is rotated counterclockwise from the shown state, the pin 18*a* which couples the movable hook 17*a* of the balk plate 18 becomes locked since the hook portion 24*a* of the upper holding hook 25*a* is engaged with the movable hook 17*a* of the balk plate 18, and accordingly, the turning force of the driving lever 23 is transmitted from the pressing element 23*b* to the balk plate 18 whereby the balk plate 18 is rotated counterclockwise about the pin 18*a*. Accordingly, the V-shaped lever 14 connected by the pin 16 is rotated clockwise and the jack lever 11 is rotated clockwise through the lever-ratio adjusting arm 13 to withdraw the wire rope 5 and descend the held frame 2 (FIG. 17).

Next, when the reciprocating lever 21 is moved in a direction opposite the above direction, the lower movable hook 17*b* of the balk plate 18 moves to a position of the lower holding hook 24*b* but the lower holding hook 25*b* is in the non-engaged state and the upper holding hook 25*a* is in the disengaged state, and therefore, when if the driving lever 23 is rotated clockwise, the movable hooks 17*a* and 17*b* on the both ends of the balk plate 18 are not restricted and free. Then, the held frame 2 is moved upward by the force of the spring explained in connection with FIG. 17 and the jack lever 11 and the V-shaped lever 14 are returned to the position shown in FIG. 16. In this manner, if the rotational position of the card drum 31 is not changed, the held frame 2 is moved up and down by one full reciprocation of the reciprocating lever 21.

If the peg 31 is inserted into the position of the contactor 28*b* of the lower holding hook 25*b*, the held frame 21 remains moved upward by one full reciprocation of the reciprocating lever 21, and if the peg 31 is not present in the position of the contactors 28*a* and 28*b* of the holding hooks 25*a* and 25*b*, the held frame 2 remains moved downward.

In this manner, the peg 31 is suitably inserted into each card 30 of the card drum 29 and the card drum 29 is rotated, whereby the holding hooks 25*a* and 25*b* for deciding the up-and-down movement of the held frame 2 are located, and plain weaving and pattern weaving can be carried out according to card information.

However, in the card drum 29, there are a few formation of cards 30 and it is difficult to carry out various pattern weavings, and when a pattern is changed, a position for inserting the peg 31 need be changed.

OBJECT AND SUMMARY OF THE INVENTION

An object of the present invention is to provide a dobby loom which can simply perform pattern weaving or the like.

For achieving the above-described object, an embodiment of the present invention provides a dobby loom provided with up-and-down movement instruction means which is controlled to two positions, operation and non-operation positions, by programmed magnetically-driven means and decides up-and-down movements of a held frame according to the two operation and non-operation positions.

An embodiment of the present invention also provides a dobby loom in which up-and-down movement selection means for a held frame is operated by controlling a magnetically-driven device, wherein displacement of the up-and-down movement selection means to the operating position is carried out by combined-use of mechanical auxiliary means and the magnetically-driven means.

DETAILED DESCRIPTION OF PREFERRED EMBODIMENT

Embodiments of the present invention will be described with reference to the drawings.

Figure 14:
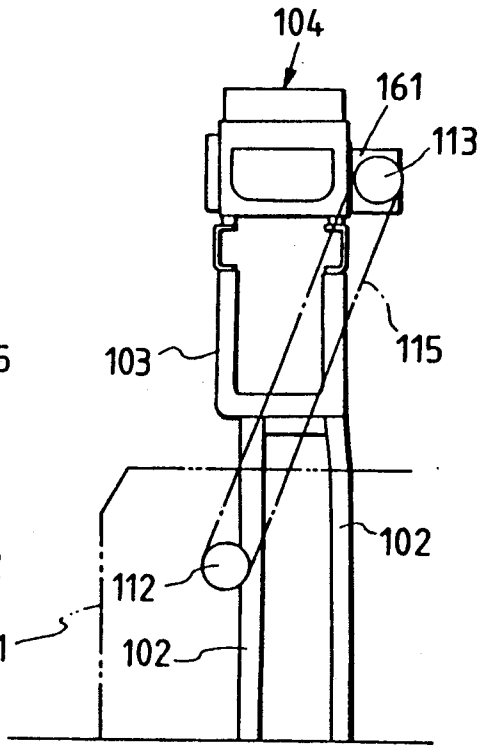
FIG. 14 is a side view of the same.
Figure 13:
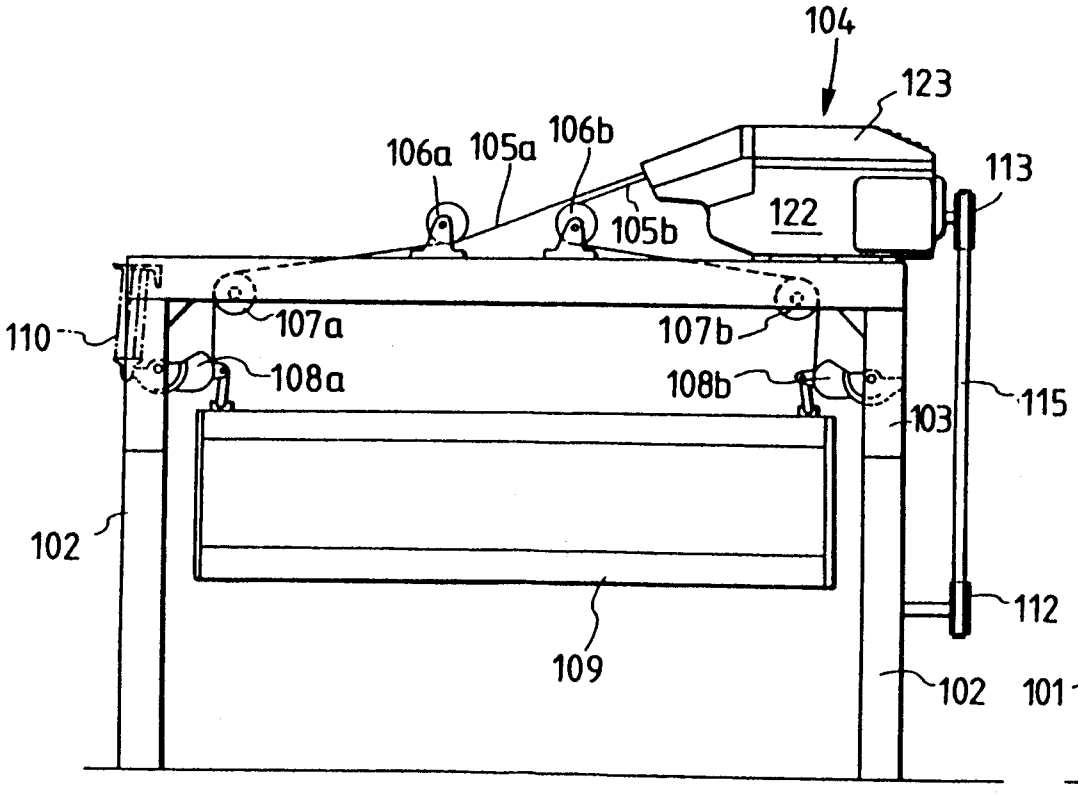
FIG. 13 is a schematic front view showing one example of a loom having a dobby according to an embodiment of the present invention.

FIGS. 13 and 14 show a schematic structure of a loom having a negative dobby mounted thereon. A dobby body 104 is mounted on frames 102 and 102 of a loom 101 through a support bed. Output of the dobby loom 104 is transmitted to swinging levers 108*a* and 108*b* via guide rollers 106*a* and 106*b*, 107*a* and 107*b* through wire ropes 105*a* and 105*b* so that a held frame 109 suspended and supported on the levers 108*a* and 108*b* by a link moves up and down. Shown in the drawing is a so-called negative dobby in which returning springs 110 are arranged on both sides of the held frame, upward movement of the held frame is effected by the dobby loom while downward movement thereof by the springs 110.

The dobby loom 104 is driven in a manner such that an output sprocket 112 on the loom side and an input sprocket 113 on the dobby loom side are connected by a timing belt 115.

Figure 1:
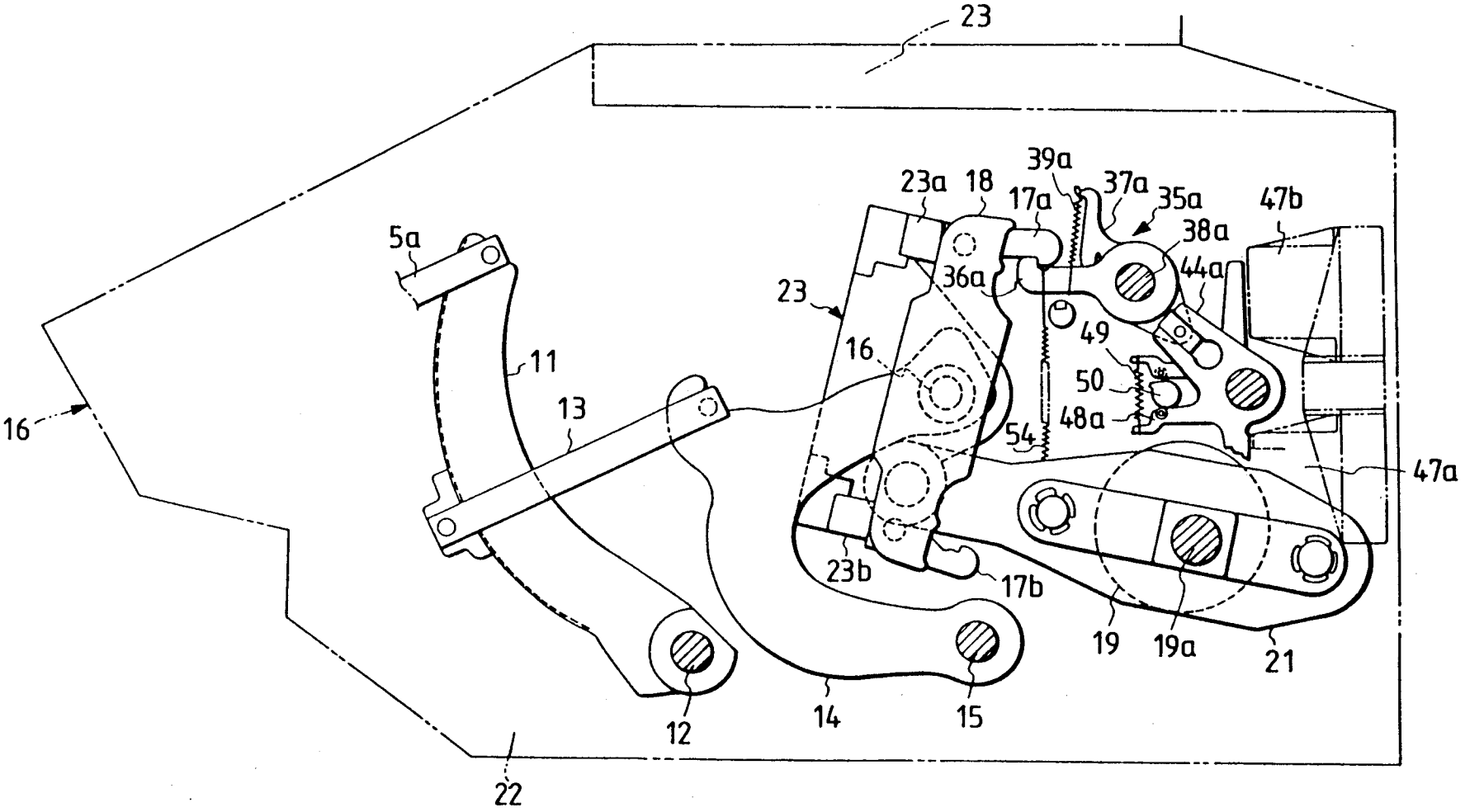
FIG. 1 is a front view showing a structure of a held frame up-and-down control portion of a dobby loom to which an embodiment of the present invention is applied.
Figure 2:
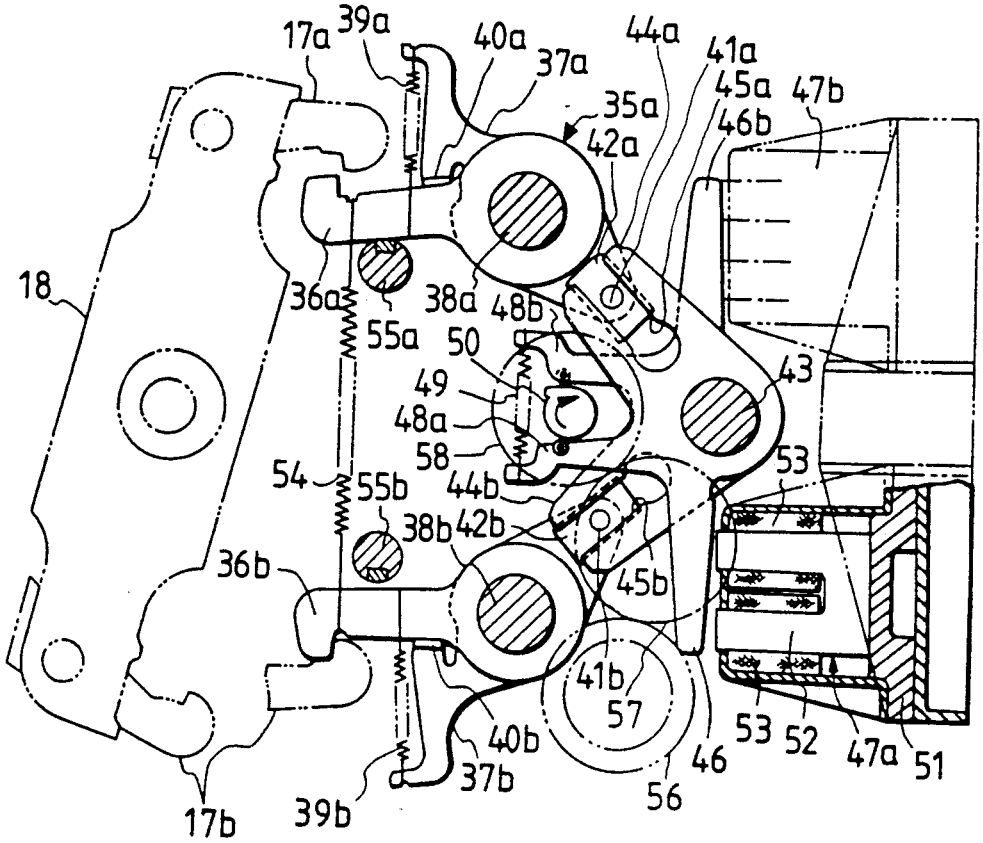
FIG. 2 is an enlarged view of essential parts thereof.
Figure 9:
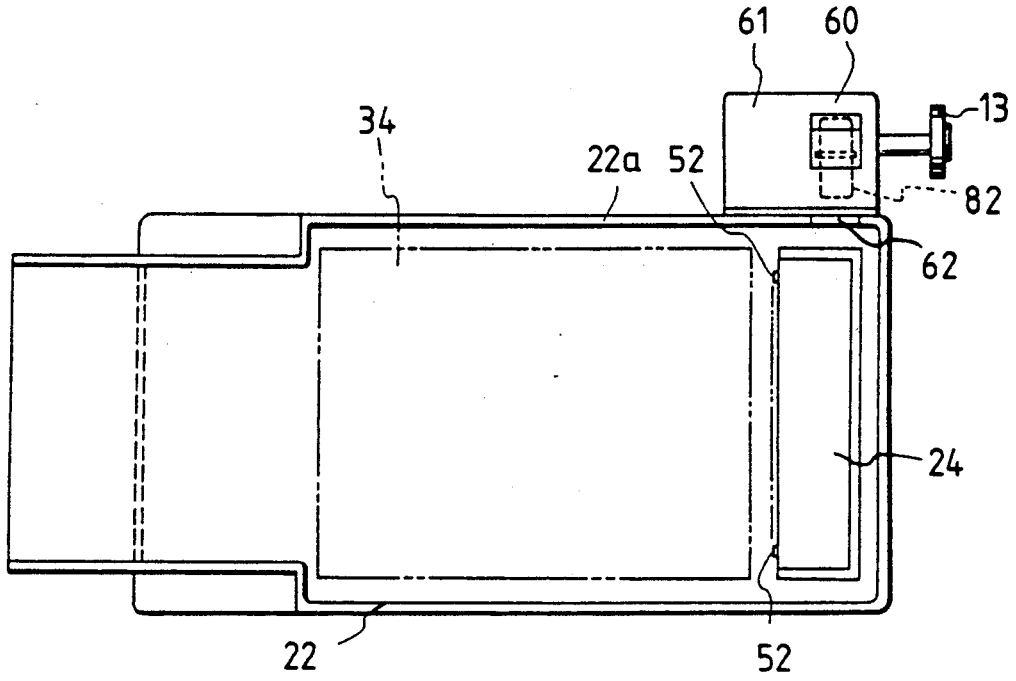
FIG. 9 is a plan view showing a frame of a dobby loom.

FIGS. 1 and 2 show the internal structure of the dobby body. That is, the dobby body is peripherally covered by walls, and only the output side of the wire rope 5*a* joined to a jack lever 11 is opened at 16. Accordingly, other portions except the opening 16 have their bottom, side and top closed by a frame 22 and a cover 23 as shown in FIGS. 1 and 9.

In FIGS. 1 and 2, holding hooks indicated at 35*a* and 35*b* which are up-and-down movement instruction means comprise hook portions 36*a* and 36*b* in engagement with movable hooks 17*a* and 17*b* of a balk plate 18 and movable portions 37*a* and 37*b* for rotating the hook portions 36*a* and 36*b* to an operating position and an unoperating position at which the hook portions 36*a* and 36*b* are engaged with and disengaged from the movable hooks 17*a* and 17*b*, respectively, said portions being rotatably provided on fixed shafts 38*a* and 38*b*, respectively. Springs 39*a* and 39*b* are provided between the movable portions 37*a* and 37*b* and the hook portions 36*a* and 36*b*, the hook portions 36*a* and 36*b* being always brought into contact with stoppers 40*a* and 40*b* of the movable portions 37*a* and 37*b* for integral rotation. Sliders 42*a* and 42*b* are connected to the movable portions 37*a* and 37*b* by pins 41*a* and 41*b*, the sliders 42*a* and 42*b* being slidably engaged with grooves 45*a* and 45*b* of action levers 44*a* and 44*b* rotatably mounted on a fixed shaft 43.

The action levers 44*a* and 44*b* have operating portions 46*a* and 46*b* formed of a magnetic material for rotating the action levers 44*a* and 44*b* to operating and unoperating positions, and solenoids 47*a* and 47*b* which are magnetically-driven means for attracting the operating portions 46*a* and 46*b* are arranged opposedly of the latter.

The action levers 44*a* and 44*b* have cam lever portions 48*a* and 48*b*, between which are provided a spring 49 as well as an auxiliary cam 50.

The solenoid 47*a* and 47*b* have a U-shaped core 52 mounted on a mounting base 51, and coils 53 and 53 are opposedly wound on both sides of the core 52.

Between the hook portions 36*a* and 36*b* of the holding hooks 35*a* and 35*b* is provided a spring 54 for urging both the hook portions 36*a* and 36*b* toward the unoperating position, and stoppers 55*a* and 55*b* are provided to define the rotation of the hook portions 36*a* and 36*b* at the unoperating position.

The auxiliary cam 50 is rotated in synchronism with the rotation of a cam 19 by a driven gear 58 connected to the auxiliary cam 50 through an intermediate gear 57 from a drive gear 56 connected to a shaft of the cam 19 for driving a drive lever 21.

The operation of the dobby loom will be described hereinafter.

First, when the hook portions 36*a* and 36*b* of the holding hooks 35*a* and 35*b* which are the up-and-down movement instruction means are in their operating positions at which the former are engaged with the movable hooks 17*a* and 17*b* of the balk plate 18, the balk lever 14 is rotated, the wire 5 is withdrawn through the jack lever 11 and the held frame 9 is moved upward. On the other hand, when the hook portions 36*a* and 36*b* are in the unoperating position which is in the state not engaged with the movable hooks 17a and 17b of the balk plate 18, the held frame is moved down by the spring 10 conversely to the former.

In order to rotate the holding hooks 35a and 35b to the operating and unoperating positions, energization to the solenoids 47a and 47b which are magnetically-driven means corresponding to the operating portions 46a and 46b of the action levers 44a and 44b for rotating the holding hooks 34a and 35b may be controlled by a program according to patterns.

Figure 3:
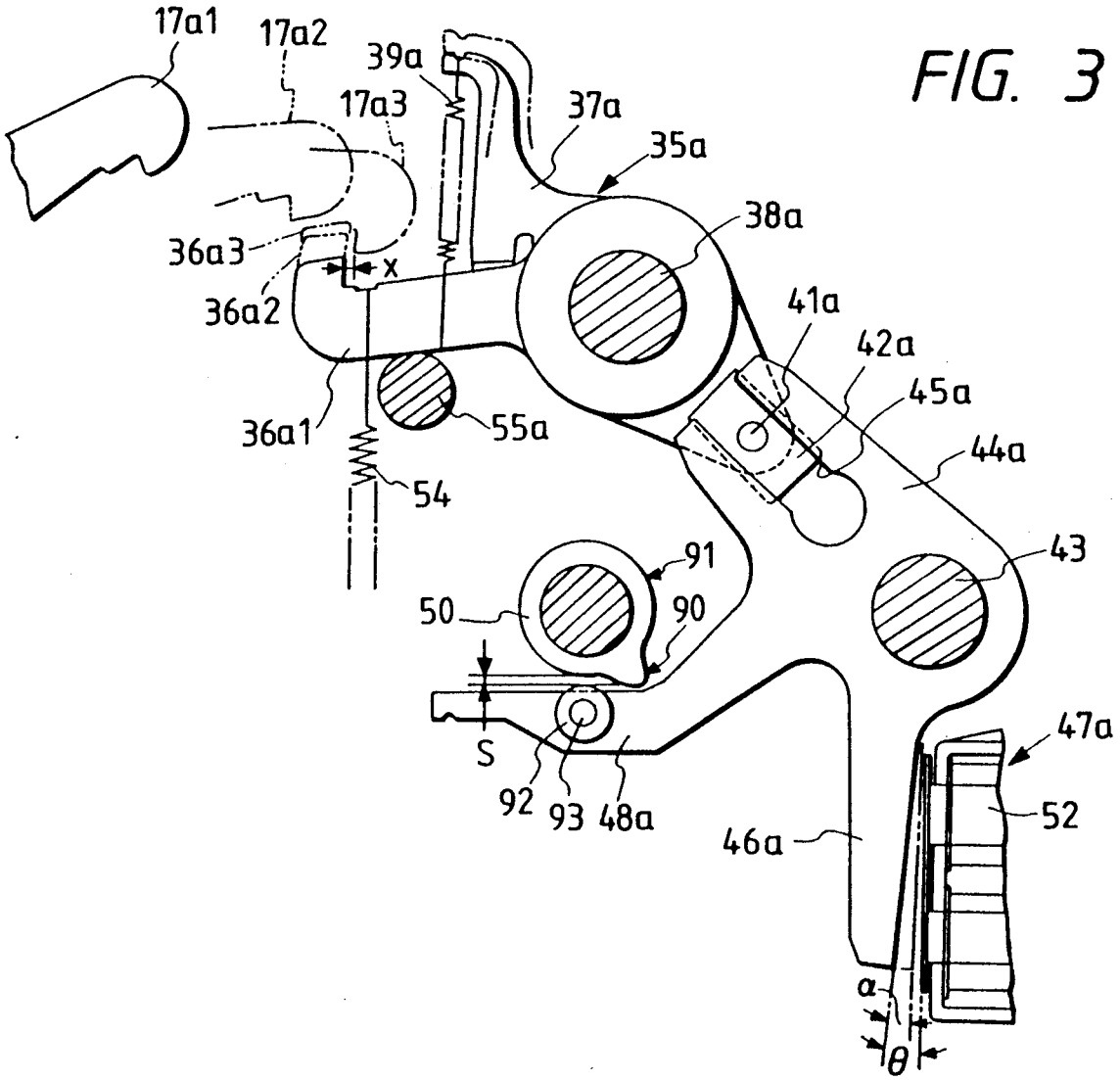
FIG. 3 is an explanatory view for operation of the holding hook.

That is, as shown in FIG. 3, when the solenoid 47a is energized, the operating portion 46a is attracted by the magnetic force of the solenoid 47a so that the portion 46a is held at the end of the core 52 of the solenoid 47a. Accordingly, the movable portion 37a of the holding hook 35a is rotated from the unoperating position indicated at the solid line to the operating position indicated at dash-dotted contour lines through the groove 45a of the action lever 44a, and at the same time, the hook portion 36a is rotated from the unoperating position indicated at the solid line to the operating position indicated at dash-dotted contour lines by means of the spring 39a to assume a state in which the hook portion 36a may engage the movable hook 17a of the balk plate 18. In this case, since the hook portion 36a is supported by the spring 39a and may be moved to the unoperating position, even if it impinges upon the movable hook 17a of the balk plate 18, it can be escaped into engagement therewith.

If the solenoid 47a is not energized, the hook portion 36a of the holding hook 35a is rotated to the unoperating position at which the former impinges upon the stopper 55a by the force of the spring 54, and at the same time the movable portion 37a is rotated through the spring 39a, and the operating portion 46a of the action lever 44a is moved away from the solenoid 47a.

The range of rotation ($\theta$) of the operating portion 46a of the action lever 44a is at a small angle (for example, 3°) since the attracting force of the solenoid 47a is limited. In order to positively attract the operating portion 46a when the solenoid 47a is energized, the cam lever portion 48a is somewhat pushed down by rotation of the auxiliary cam 50 to mechanically urge the operating portion 46a toward the solenoid 47a by angle ($\alpha$) from the solid-line position, whereby attraction can be attained by the solenoid 47a of relatively small capacity. The rotation of the action lever 44a of the auxiliary cam 50 is set in the range in which the hook portion 36a of the holding hook 35a is not engaged with the movable hook 17a and so that the operating portion 46a assumes a position closest to the solenoid 47a.

The cam 50 which is the mechanical auxiliary means for displacement of the holding hook comprises, as shown in FIG. 3, a first cam surface 90 for displacing the holding hook 35a to the engaging position and a circular second cam surface 91 for maintaining the holding hook 35a at the unengaging position. A cam follower 92 in the form of a free roller in contact with the cam 50 is rotatably supported by a bearing 93 on the cam lever portion 48a of the holding hook 35a. The cam follower 92 is spaced apart from the cam 50 by a space S when the holding hook 35a is in the engaging position. Timing by which the hook portion 36a of the holding hook 35a is engaged with or disengaged from the hook portion of the movable hook 17a need be effected during the time when the movable hook 17a is in the most advanced position 17a3 in FIG. 3, that is, only during the time when a clearance x is formed between the engaging surfaces between the movable hook 17a and the holding hook 35a, and therefore, time required for displacement of the holding hook 35a is limited.

Figure 4:
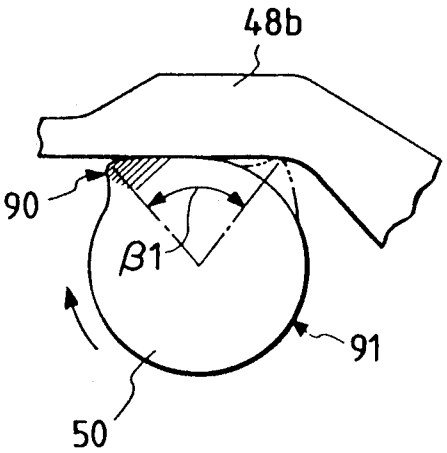
FIGS. 4 to 6 are respectively side views showing the relationship between a cam and a holding hook.
Figure 5:
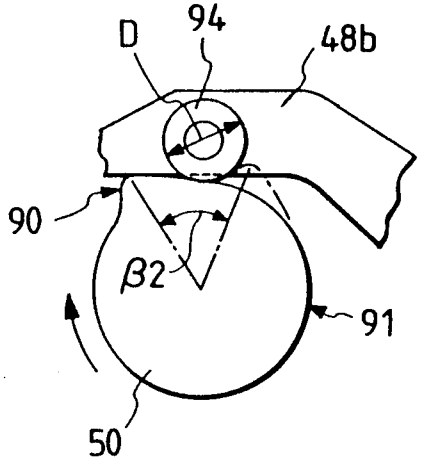
Figure 6:
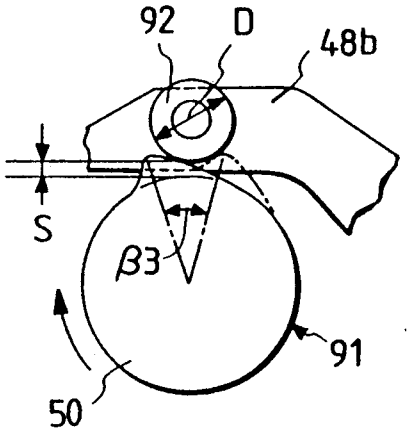

The time required for displacement is proportional to the rotational angle of the cam 50. FIGS. 4 to 6 show various relationships between the cam lever and the cam. The cam 50 is of one and the same structure. In the case of FIG. 4, the second cam surfaces 90 and 91 are in direct contact with the cam lever 48b, and there is no clearance x between the cam surface 91 and the cam lever. The holding hook, i.e., the cam lever 48b is displaced by the first cam surface 90 during the time when the cam 50 is rotated through angle ($\beta 1$). In the FIG. 5 case, the cam follower 94 on the cam lever 48b is provided at a position in which the former is in contact with the second cam surface 91. In this case, the time of displacement of the holding hook is during the angle ($\beta 2$), which is in the relationship of $\beta 2 < \beta 1$.

In the FIG. 6 case, a clearance S is provided between the cam follower 92 and the second cam surface 91 as shown in FIG. 3, and the cam follower 92 has the same diameter D as that of the cam follower 94 as shown in FIG. 5. At that time, the time for displacement of the holding hook is during the angle ($\beta 3$), which is in the relationship of $\beta 3 < \beta 2 < \beta 1$.

Accordingly, since in the embodiment (FIG. 3) of the present invention, the displacement time of the holding hook is short, the selective control of the up-and-down movement of the held frame for an extremely short period of time may be carried out. Thus, even at the time of reverse operation of the loom during pick-finding operation when weft is cut, the holding hook 35a can be moved up and down at substantially the same timing as that of normal operation.

In the aforementioned description, the case of the upper holding hook 35a in FIG. 3 and the case of the lower holding hook 35b in FIGS. 4 to 6, respectively, have been described.

That is, if the solenoid 47b is energized, the holding hook 35b is rotated to the operating position, whilst when not energized, the hook to the unoperating position. The holding hook 35b is rotated so that the operating portion 46b of the action lever 44b is moved closer toward the solenoid 47b by the auxiliary cam 50.

With the above-described arrangement, if both the solenoids 47a and 47b are energized, both the holding hooks 35a and 35b are in the operating position, and the held frame 9 remains at the up position during one full rotation of the cam 19. If both the hooks are not energized, the held frame 9 remains at the down position. When either of the solenoids is energized, the held frame 9 is moved up and down during one full rotation of the cam 19.

These solenoids 47a and 47b are provided in rows (16 rows). Solenoids in group of solenoids in each row are turned ON and OFF in synchronism with rotation of the cam 19 according to the patterns to be woven.

Figure 8:
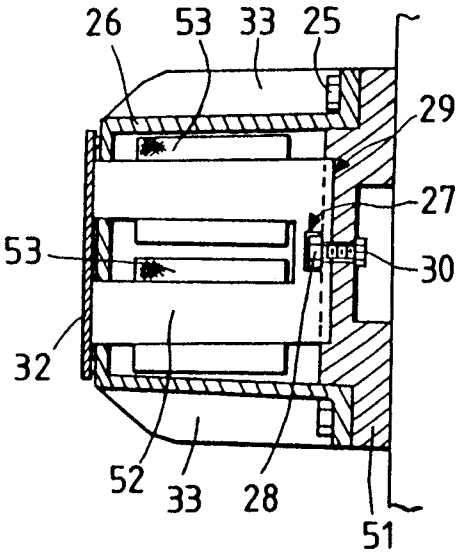
FIG. 8 is a sectional front view of the same.
Figure 7:
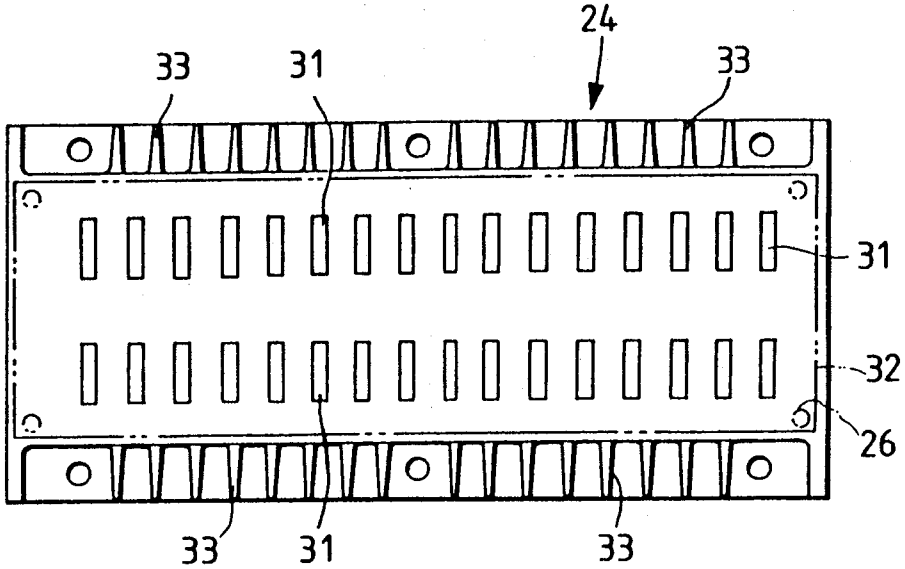
FIG. 7 is a side view showing one example of a solenoid box.

That is, as shown in FIGS. 7 and 8, one solenoid box 24 is composed of a mounting base 51 and a cover 26 secured at 25 to the base 51, and a solenoid comprising a core 52 and a coil 53 within the cover. Mounting of the solenoid to the mounting base 51 is accomplished by forming a C-shaped recess 27 in a part of a ]-shaped core, as shown in FIG. 8, unrotatably fitting a nut body 28 into said recess, inserting the core 52 in that state into a slit 29 having a width substantially equal to a thickness of the core formed in the mounting base 51, thereafter inserting a bolt 30 thereinto from the back of the base 51, tightening the nut body 28 and securing the core 52 to the side of the base 51. The end of the core 52 is provided while being slightly extended from a longitudinal window (31 in FIG. 7) provided in the cover. Winding direction of the coils 53 and 53 wound around the core 52 is set to the opposite direction so that the direction of a magnetic field forms a closed loop in one direction.

A non-magnetic member for reducing an influence of residual magnetism is disposed in a space on which attractive force caused by a magnetic force exerts between the magnetically-driven means and the up-and-down selection means of the held frame. That is, a thin plate 32 formed of a non-magnetic material such as stainless or nylon is disposed in the entire area of the attractive surface at the end of the core of the plurality of solenoids, the plate being mounted on the cover 26 by fixing means such as a pin. That is, the area indicated by the dash-dotted contour line 32 in FIG. 7 denotes the plate. The plate is mounted with a slight play so as to reduce the wear resulting from the attraction at the same place.

When the operating portion 46*a* of the action lever 44*a* is directly attracted by the core 52, residual magnetism is generated in the core 52 at a moment when current flowing into the coil 53 is turned off, and therefore, time is required to move the operating portion 46*a* from the core, thus impeding the high-speed rotation of the dobby. Because of this, the operating portion is made to be attracted by the entire area of the front surface of the core through the plate 32 in the form of a non-magnetic body. That is, the end of the core and the operating portion 46*a* are attracted through the space having a thickness of the plate. In this case, the residual magnetism is less affected, and timing for engagement and disengagement between the hook portions 36*a* and 36*b* and the movable hooks 17*a* and 17*b* may be easily taken. That is, as shown in FIG. 3, this timing is set so that at a moment when the movable hook 17*a* arrived at the engaging position 17*a*3, the hook portion 36*a* is located at the engaging position 36*a*3 or non-engaging position 36*a*1. Accordingly, if the hook portion 36*a*3 takes time to moved to the non-engaging position 36*a*1, the movable hook must remain still for a long period of time at the most advanced position 17*a*3, lowering the rotation of the dobby.

Suitable thickness of the plate 32 is 0.1 to 1.0 mm. If the thickness of the plate 32 increases, the clearance between the end of the core and the operating portions 46*a* and 46*b* increases and the attractive force is remarkably reduced. According to experiments, for example, when the thickness of the plate 32 is 1.0 mm and a voltage is applied, the attractive force is 5.2 kg; when the thickness thereof is 2 mm and a voltage is applied, the attractive force is 1.3 kg; when the thickness is 3 mm, the attractive force is 0.6 kg; and when the thickness is 4 mm, the attractive force is 0.3 kg. The thickness of the plate is preferably of 1.0 mm or less.

The plate 32 is provided over the entire area of the attractive surface of the solenoid box as shown in FIG. 7, and also has the effect to prevent adhesion of oil to the core portion resulting from scattering of oil supplied to a number of movable hooks and holding hooks.

The cover 26 of the solenoid box is formed on upper and lower surfaces with a number of radiation fins 33. The sectional shape of the fins can be suitably changed into the shape that may be easily fabricated.

In order that the action levers 44*a* and 44*b* are controlled by the solenoid, the solenoid box 24 portion is heated, and as a result, the resistance of a conductive body is reduced, current becomes easy to flow, electric power is increased, resulting in a loss of energy. Therefore, the dobby is further provided with a cooling device for the solenoid box.

Figure 10:
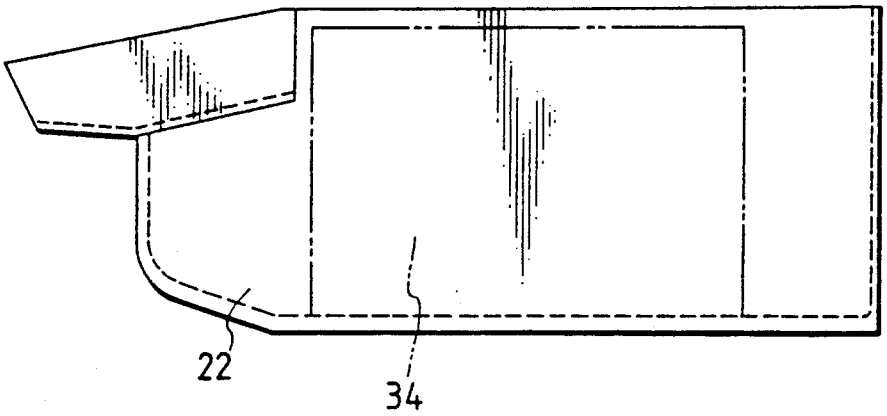
FIG. 10 is a front view of the same.

FIGS. 9 and 10 show a box with a cover (23 in FIG. 13) for a dobby loom removed. That is, within a box-shaped frame 22, a group of various levers shown in FIGS. 1 and 2 are disposed in an area 34 surrounded by dash-dotted contour lines in FIG. 9, a solenoid box 24 being mounted at the right end of the frame.

A cooling device 60 is provided within an input gear box 61 which receives a power from the loom externally of the frame 22. In a conventional dobby loom in which patterns and tissues are controlled by a peg card, a card cylinder is mounted at a position of the solenoid box 24 in FIG. 9. A frame 22*a* is formed with a hole 62 through which a cylinder driving shaft extends, said hole 62 being utilized to supply an air flow fed from the cooling device to the solenoid box 24 portion.

Figure 12:
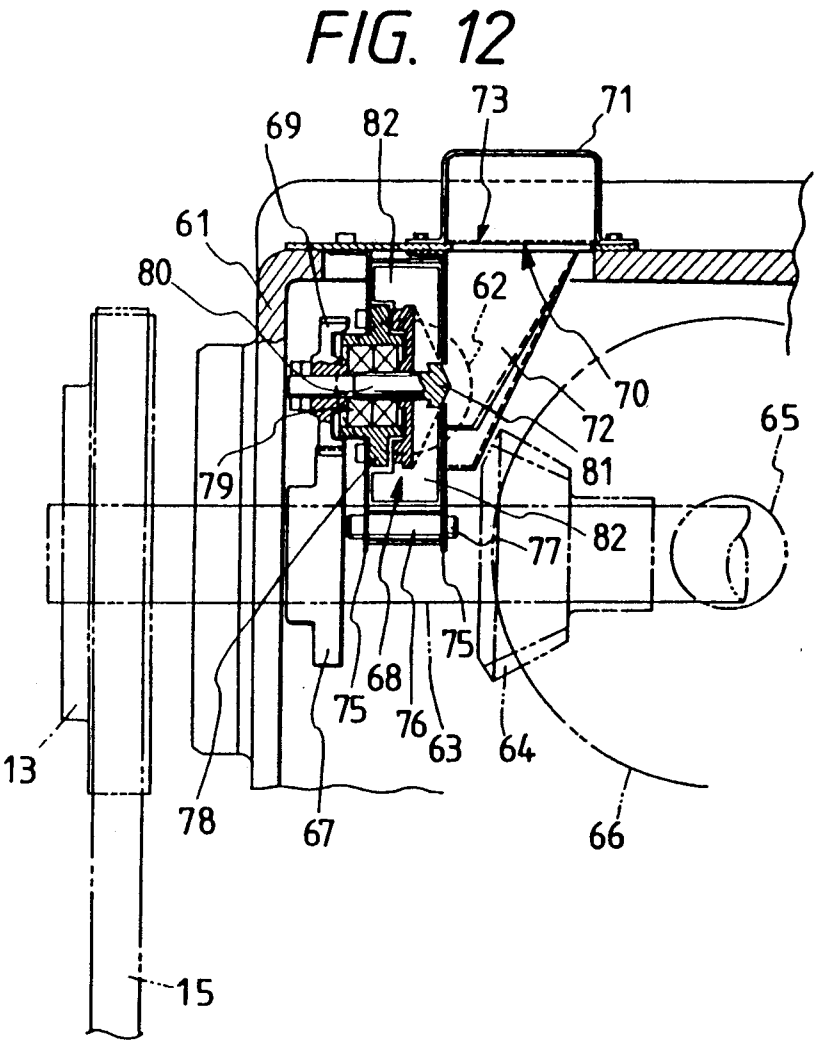
FIG. 12 is a rear view of the same.

FIGS. 10 and 12 show an embodiment of the cooling device. A shaft 63 for receiving an rotational output from a loom shown in FIG. 14 through a belt 15 extends the input gear box 61, and power is transmitted to a large bevel bear 66 secured to a dobby driving shaft 65 perpendicular to the shaft 63 from a small bevel gear 64 keyed to the shaft 63, as shown in FIG. 11, the driving lever 21 being operated through the cam 19 shown in FIG. 1.

A spur gear 67 is secured in the midst of the input shaft 63, and a gear 69 for driving a fan 68 is meshed with the gear 67. The input gear box 61 is formed in the upper surface with an air intake opening 70, and an air intake duct 71 and a guide duct 72 are fixed thereat. A wire net 73 for preventing entry of air cotton, dust or the like is provided over the opening 70. A pair of plates 74 and 75 for supporting a fan are suspended and fixed from the upper surface internally of the box 61 and fixed by bolts 77 through a spacer 76 between the plates 74 and 75. A housing 78 is secured to one plate 75, and a shaft 80 is rotatably supported therein through a bearing 79. The shaft 80 has a gear 69 secured to one end thereof and a fan mounting element 81 secured to the other end thereof. Eight blades 82 are secured to a slit of the element 81 to constitute a fan. Reference numeral 83 denotes a cover for covering the outer peripheral surface of the blades. An air flow flows into the frame from the window 62 of the frame 22 through a duct 84.

Figure 11:
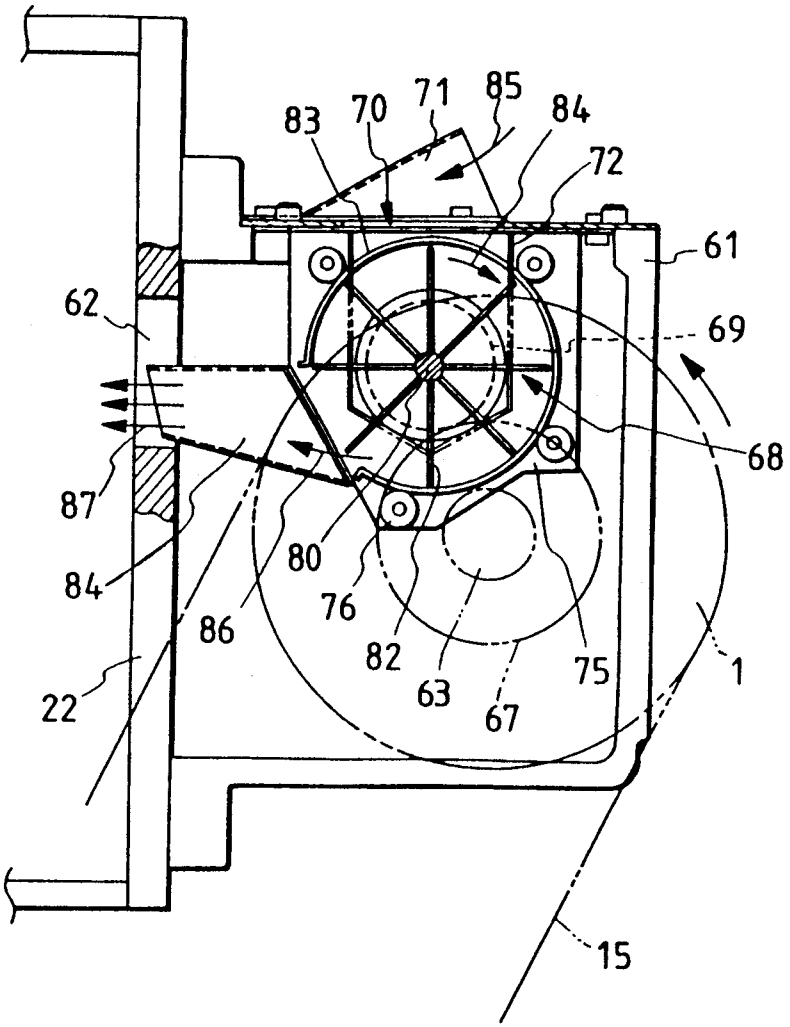
FIG. 11 is a side view showing an embodiment of a cooling device.

Accordingly, the fan 68 is driven by power obtained from rotational motion of the loom without requiring own driving source, and the rotational speed of the fan is suitably set by varying the ratio of tooth number of gears 67 and 69 in FIGS. 11 and 12. As the operating speed of the loom increases, the rotation of the fan increases, and the flow rate of air increases to enhance the cooling effect.

By the cooling device having the construction as described above, the fan 68 rotates in a direction as indicated by arrow 84 upon commencement of operation of the loom, and open air flowing from the duct 71 flows as indicated by arrows 85, 86 and 87 and flows around the solenoid box 24 within the frame in FIG. 9, whereby heat caused by the solenoid is escaped with the radiation action of the fins 33 in FIGS. 7 and 8.

Since the frame 22 is peripherally covered as previously described, the incoming air flow flows out of the opening 16 through which the wire shown in FIG. 1 passes, and an air flow from the interior of the dobby loom toward the outside always occurs to prevent entry of air cotton, dust or the like into the dobby loom.

The solenoids 47*a* and 47*b* are provided in rows (eight rows). Solenoids in a group of solenoid of each row are controlled to be turned ON and OFF in synchronism with the rotation of the cam 19 according to patterns to be woven. The ON and OFF control of the solenoids can be done by storing in advance pattern information in IC cards or magnetic cards and then by the cards.

This will be described with reference to FIG. 15.

Figure 15:
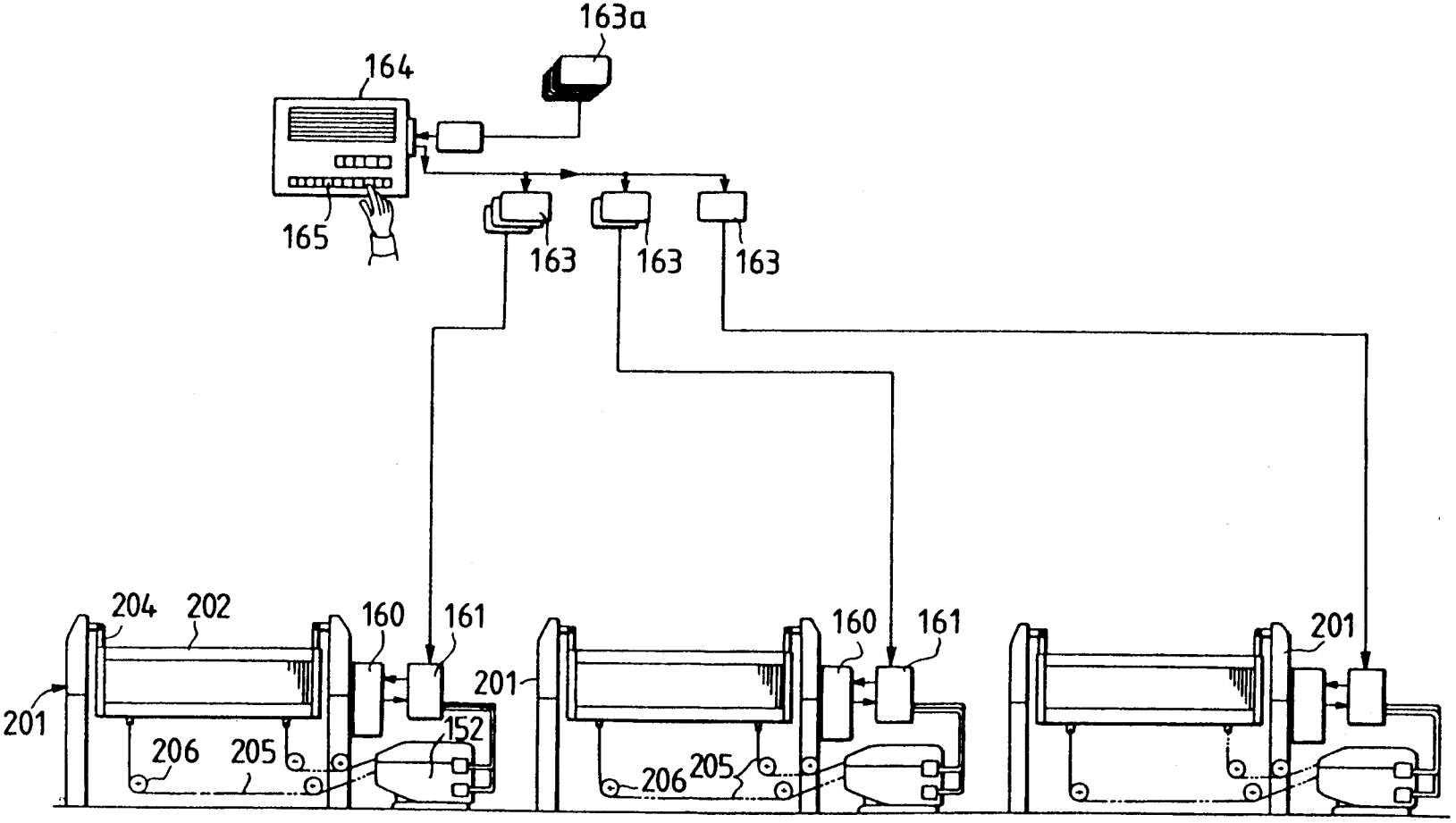
FIG. 15 is a schematic view showing a control example by IC card according to an embodiment of the present invention.
Figure 16:
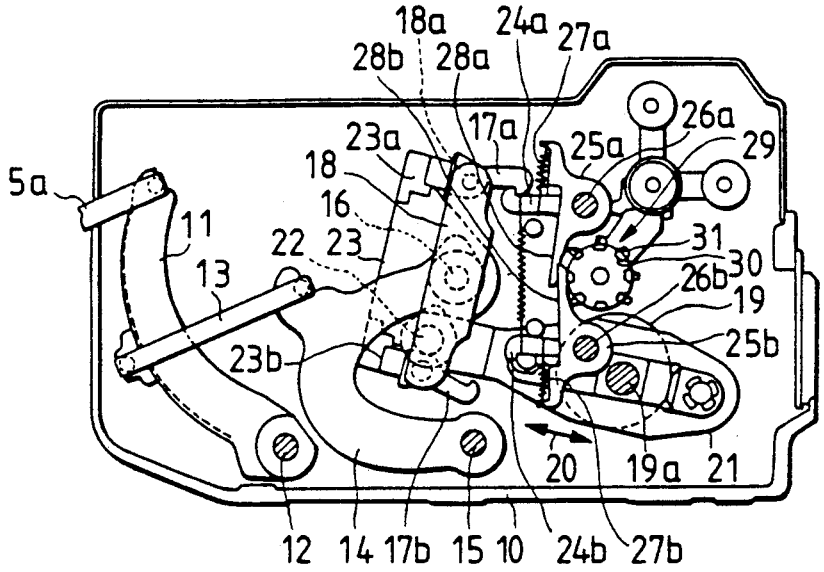
FIG. 16 PRIOR ART
FIG. 16 is a sectional view of a conventional dobby loom.
Figure 17:
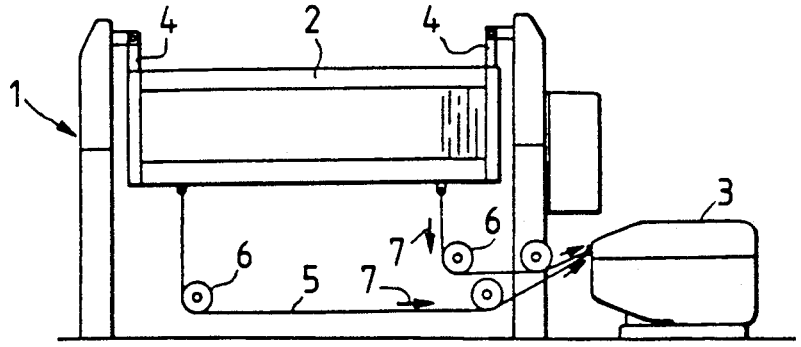
FIG. 17 PRIOR ART
FIG. 17 is a view showing one example of a loom.

First, in FIG. 15, in a loom frame 201, there is provided an electronically-controlled device 160 for a loom which drives and controls electric and electronic parts of the loom. Connected to the electronically-controlled device 160 is a tissue card read device 161 for receiving instruction information. The read device 161 reads tissue information inputted in the card 163, input it into the electronically-controlled device 160, receives control information from the electronically-controlled device 160, controls the weaving machine according to information of the inserted card 163, and ON and OFF controls the solenoids of the dobby loom 162.

On the other hand, a card 163 or an un-stored card 163*a* is first set in a tissue memory 164, an operating portion 165 of the memory 164 is operated, ON and OFF information of solenoids are stored according to the pick of weft to form various tissue cards 163, which are mounted to the read device 161 of each loom. Then, the held frame 202 is moved up by each dobby loom 161 according to the card information for accomplishment of weaving.

As described above, according to an embodiment of the present invention, a plate formed of a non-magnetic material is arranged between the core which is magnetically-driven means and the operating portion of the holding hook which is up-and-down movement selection means of the held frame. Therefore, the residual magnetism less influences, and accordingly, the operating time of the up-and-down movement selection means for the held frame can be shortened to enhance the rotational speed of the dobby loom, which is capable of coping with the high-speed operation of a reformed loom.

In an embodiment of the present invention, since the holding hooks are placed in the operating or unoperating position by the solenoids, no card for pegs are needed as was so in prior art and the solenoids are ON and OFF controlled to effect weaving. Control of pattern weaving can be simply done by IC cards or the like and changes thereof may also be done simply.

Furthermore, according to an embodiment of the present invention, in carrying out the engagement and disengagement between the holding hook and the movable hook by the magnetically-driven means, the holding hook is moved in advance by the cam which is the mechanical auxiliary means, and in the state wherein the holding hook is close to the electromagnetic solenoid, the solenoid is turned on and off. Therefore, the attractive force of the solenoid itself can be assisted and thus an electromagnetic solenoid having a small capacity can be applied. In addition, since control time is short, the holding hook can be operated following the rotational speed of the loom.

What is claimed is:

1. A dobby loom in which up-and-down movement selection means for a held frame is operated by controlling a magnetically-driven device, characterized in that displacement of said up-and-down movement selection means is carried out by the combined-use of mechanical auxiliary means and said magnetically-driven means;

wherein said up-and-down movement selection means comprises a pair of holding hooks including means for engaging with a balk plate, and a pair of action levers engaged with one of the holding hooks, respectively;

wherein said holding hook comprises a hook portion and movable portion for rotating the hook portion to an operating position and an nonoperating position at which the hook portion is engaged with an disengaged from a movable hook of the balk plate, said hook portion and movable portion being rotatably provided on fixed shafts, respectively, and being connected by a spring for integral rotation;

wherein said action lever is movable between an operating position and a nonoperating position and includes an operating portion formed of a magnetic material for rotating the action lever between the operating and nonoperating positions, and solenoids comprising magnetically driven means for attracting the operating portion are arranged opposedly of the operating portion;

wherein a pair of said action levers which are arranged face to face with each other have cam lever portions, between which are provided a spring and an auxiliary cam, said auxiliary cam constituting the mechanical auxiliary means; and wherein said auxiliary cam comprises a first cam surface for displacing the holding hook to the engaging position and a circular second cam surface for maintaining the holding hook at the nonengaging position, said auxiliary cam being in contact with a cam follower rotatably supported on the cam lever portion of the action lever so that the cam lever portion is pushed down by rotation of the auxiliary cam to mechanically urge the operating portion toward the solenoid.

2. A dobby loom in which up-and-down movement selection means for a held frame is operated by controlling a magnetically-driven device, characterized in that a non-magnetic member is disposed in a space on which acts an attractive force caused by a magnetic force between said magnetically-driven device and said up-and-down movement selection means;

wherein said magnetically-driven device includes a plurality of solenoids comprising cores and coils each of said cores having an attractive surface; and wherein said non-magnetic member includes a thin plate formed of a non-magnetic material is disposed on the attractive surface at the end of the cores of the plurality of solenoids;

wherein radiation fins for cooling the solenoids are provided on both sides of a cover in which a plurality of rows of solenoids are arranged;

wherein a cooling device including a fan is provided within an input gear box for receiving a driving force from a loom and the cooling device supplies an air flow to the radiation fins.

3. The dobby loom as claimed in claim 2, wherein said up-and-down movement selection means comprises a pair of holding hooks including means for engaging with a balk plate, and a pair of action levers engaged with one of the holding hooks, respectively.

4. The dobby loom as claimed in claim 3, wherein said holding hook comprises a hook portion and movable portion for rotating the hook portion to an operating position and an unoperating position at which the hook portion is engaged with and disengaged from a movable hook of the balk plate; said hook portion and movable portion being rotatably provided on fixed shafts, respectively, and being connected by a spring for integral rotation.

5. The dobby loom as claimed in claim 4, wherein said action level includes an operating portion formed of a magnetic material for rotating the action lever to operating and unoperating positions, and solenoids which are magnetically driven means for attracting the operating portion are arranged opposedly of the operating portion.

6. The dobby loom as claimed in claim 5, wherein a pair of said action levers which are arranged face to face with each other have cam lever portions, between which are provided a spring and an auxiliary can, said auxiliary cam being constituting the mechanical auxiliary means.

7. The dobby loom as claimed in claim 2, wherein said thin plate is formed of stainless steel.

8. The dobby loom as claimed in claim 2, wherein said thin plate is formed of nylon.

* * * * *